US006644854B2

(12) United States Patent
Lien

(10) Patent No.: US 6,644,854 B2
(45) Date of Patent: Nov. 11, 2003

(54) WATER BAG FOR BICYCLE RIDERS

(76) Inventor: Chien-Ping Lien, P.O. Box 82-144, Taipei (TW)

( * ) Notice: Subject to any disclaimer, the term of this patent is extended or adjusted under 35 U.S.C. 154(b) by 0 days.

(21) Appl. No.: 10/164,388

(22) Filed: Jun. 10, 2002

(65) Prior Publication Data

US 2003/0194156 A1 Oct. 16, 2003

(30) Foreign Application Priority Data

Apr. 11, 2002 (TW) ..... 91204722 U

(51) Int. Cl.[7] ..... B65D 33/16

(52) U.S. Cl. ..... 383/66; 383/59; 383/61.2; 383/63; 383/89; 383/906; 222/92; 222/175

(58) Field of Search ..... 383/66, 41, 59, 383/61.2, 63, 88, 89, 906; 24/585.1; 222/92, 175

(56) References Cited

U.S. PATENT DOCUMENTS 5,244,136 A * 9/1993 Collaso ..... 224/673
5,282,557 A * 2/1994 McCook ..... 224/148.2
5,540,366 A * 7/1996 Coomber ..... 224/677
5,774,955 A * 7/1998 Borchardt et al. ..... 24/584.1
5,816,709 A * 10/1998 Demus ..... 383/61.2
5,913,456 A * 6/1999 Dikeman ..... 222/95
5,941,640 A * 8/1999 Thatcher ..... 383/22
6,167,597 B1 * 1/2001 Malin ..... 24/585.1
6,176,394 B1 * 1/2001 Shimko et al. ..... 222/92
6,185,796 B1 * 2/2001 Ausnit ..... 24/585.1
6,267,506 B1 * 7/2001 Campion ..... 383/59

* cited by examiner

*Primary Examiner*—Jes F. Pascua
(74) *Attorney, Agent, or Firm*—Leong C. Lei

(57) ABSTRACT

A water bag is provided having a water outlet tube at the bottom side, a mouth at the top side, transverse locating ribs and transverse locating grooves symmetrically disposed in inner sidewalls of two opposite bag body panels of the mouth and adapted for sealing the mouth, and a strip and hook material and a strip of loop material provided at the outer sidewalls of the bag body panels at two sides for fastening to each other to hold the mouth in a closed rolled up status.

2 Claims, 5 Drawing Sheets

WATER BAG FOR BICYCLE RIDERS

BACKGROUND OF THE INVENTION

1. Field of the invention

The present invention relates to a water bag and, more particularly, to such a water bag, which is specifically designed for bicycle riders.

2. Description of the Related Art

FIG. 1 illustrates a water bag according to the prior art. This structure of water bag comprises a collapsible bag body 1, a filling hole 2 disposed near the bottom side of the bag body 1, a cap 3 hinged to the bag body 1 and adapted for closing the filling hole 2, a suction tube 4 extended from the bag body 1 near the top side for enabling the user to suck in water from the bag body 1, a suction valve 5 adapted for closing/opening the suction tube 4, and a drain valve 6 at the bottom side of the bag body 1. This structure of water bag is collapsible and suitable for use outdoors. However, it is inconvenient to clean the inside wall of the bag body 1. When cleaning the inside wall of the bag body 1, the user must insert a stick brush through the filling hole 2 to rub the inside wall of the bag body 1. Tis cleaning method cannot thoroughly clean all comers inside the bag body 1.

Therefore, it is an object of the present invention to provide an improved water bag for bicycle riders which can obviate the above drawbacks.

SUMMARY OF THE INVENTION

The present invention relates to a water bag and, more particularly, to such a water bag, which is specifically designed for bicycle riders.

The present invention has been accomplished to provide a water bag, which eliminates the aforesaid problem. It is therefore the main object of the present invention to provide a water bag, which is specifically designed for bicycle riders. It is another object of the present invention to provide a water bag, which enables the user to conveniently thoroughly clean the inside of the bag body. To achieve this and other objects of the present invention, the water bag is provided having a water outlet tube at the bottom side and a mouth at the top side. Transverse locating ribs and transverse locating grooves are symmetrically disposed in inner sidewalls of two opposite bag body panels of the mouth and adapted for sealing the mouth. A strip and hook material and a strip of loop material are provided at the outer sidewalls of the bag body panels at two sides for fastening to each other to hold the mouth in a closed rolled up status. When the mouth opened, the user can easily thoroughly clean the inside of the bag body of the water bag.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
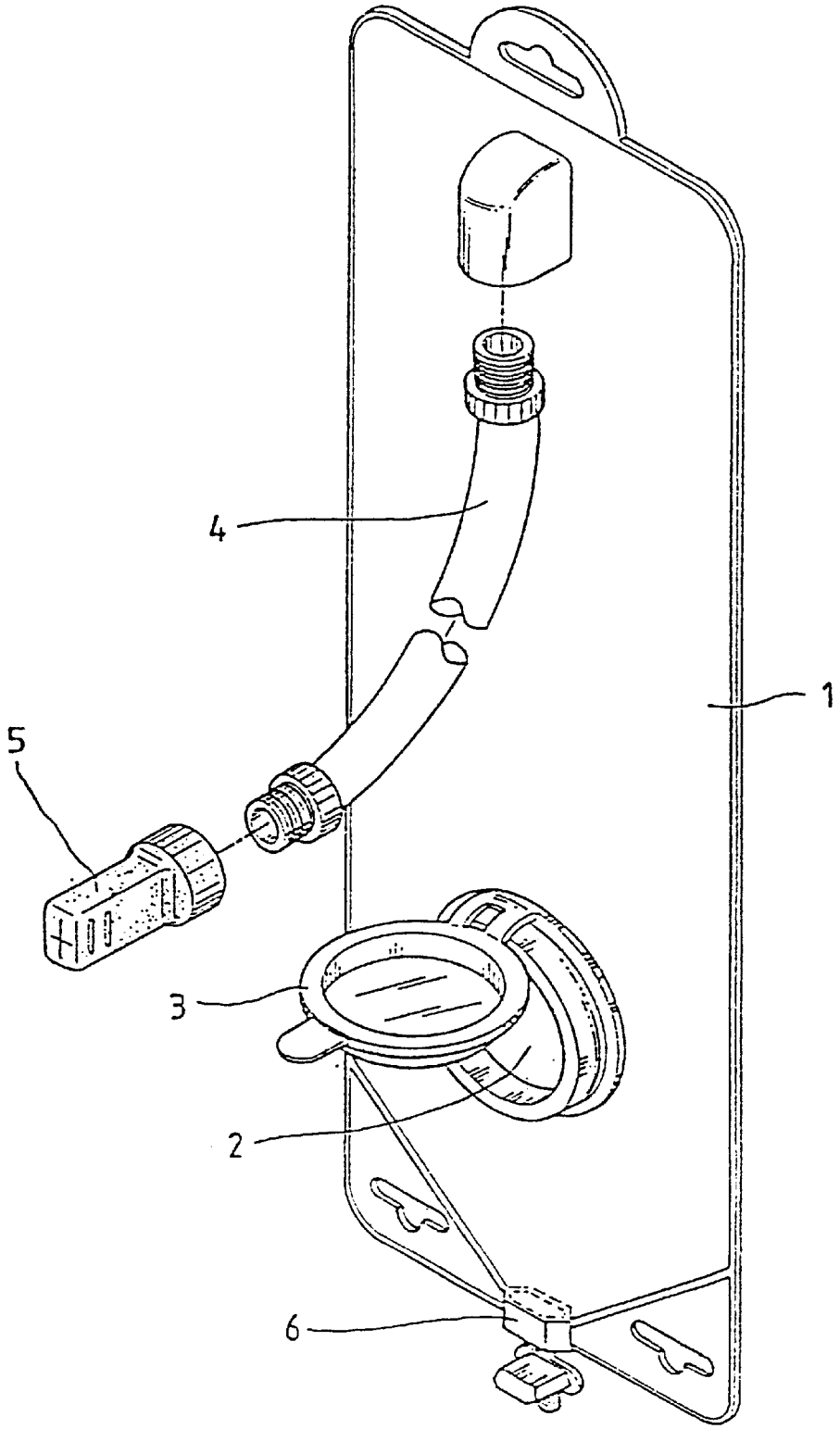
PRIOR ART FIG. 1
FIG. 1 is a schematic drawing showing a water bag according to the prior art.
Figure 2:
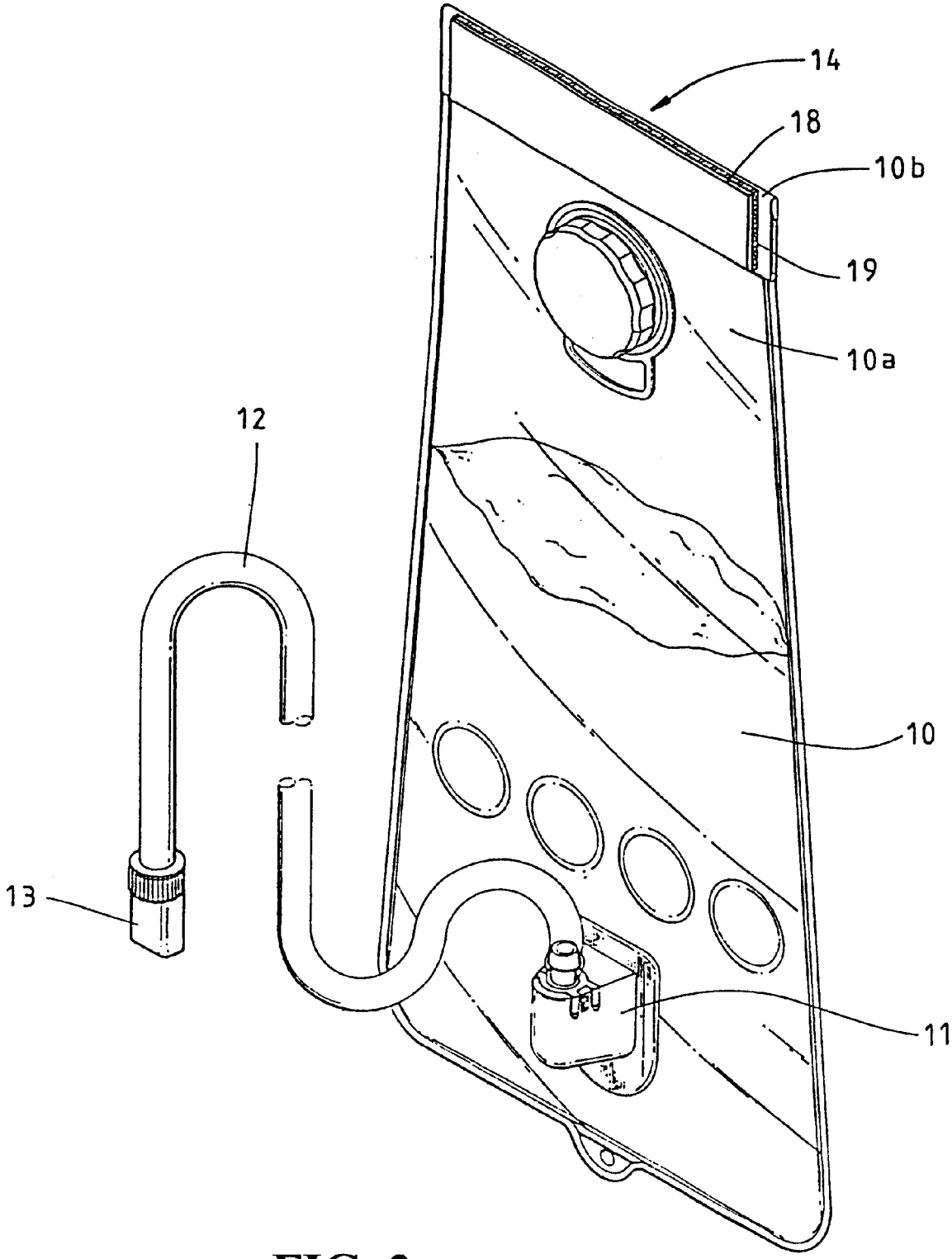
FIG. 2 is a schematic drawing showing the outer appearance of a water bag according to the present invention.

Referring to FIG. 2, a water bag is shown comprising a collapsible waterproof bag body 10 adapted for holding drinking water, a water outlet 11 disposed near the bottom side of the bag body 10 for output of drinking water, a flexible water tube 12 extended from the water outlet 11, and a suction valve 13 fastened to the free end of the water tube 12 through which the user sucks in drinking water from the bag body 10. The water bag is convenient for carrying by the user or on the bicycle during an outdoor sports game or activity.

Figure 3:
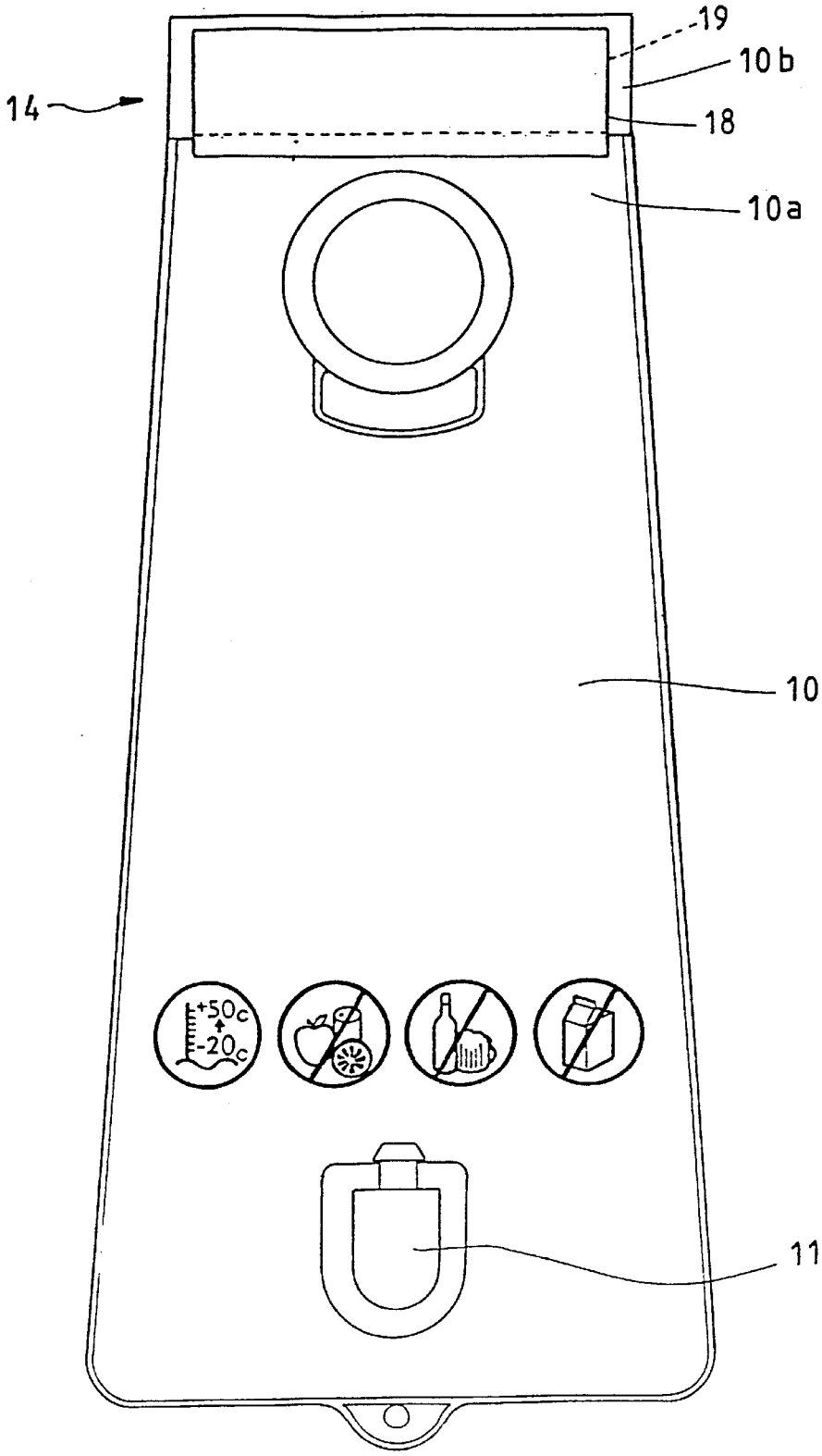
FIG. 3 is a front view of the water bag according to the present invention.
Figure 4:
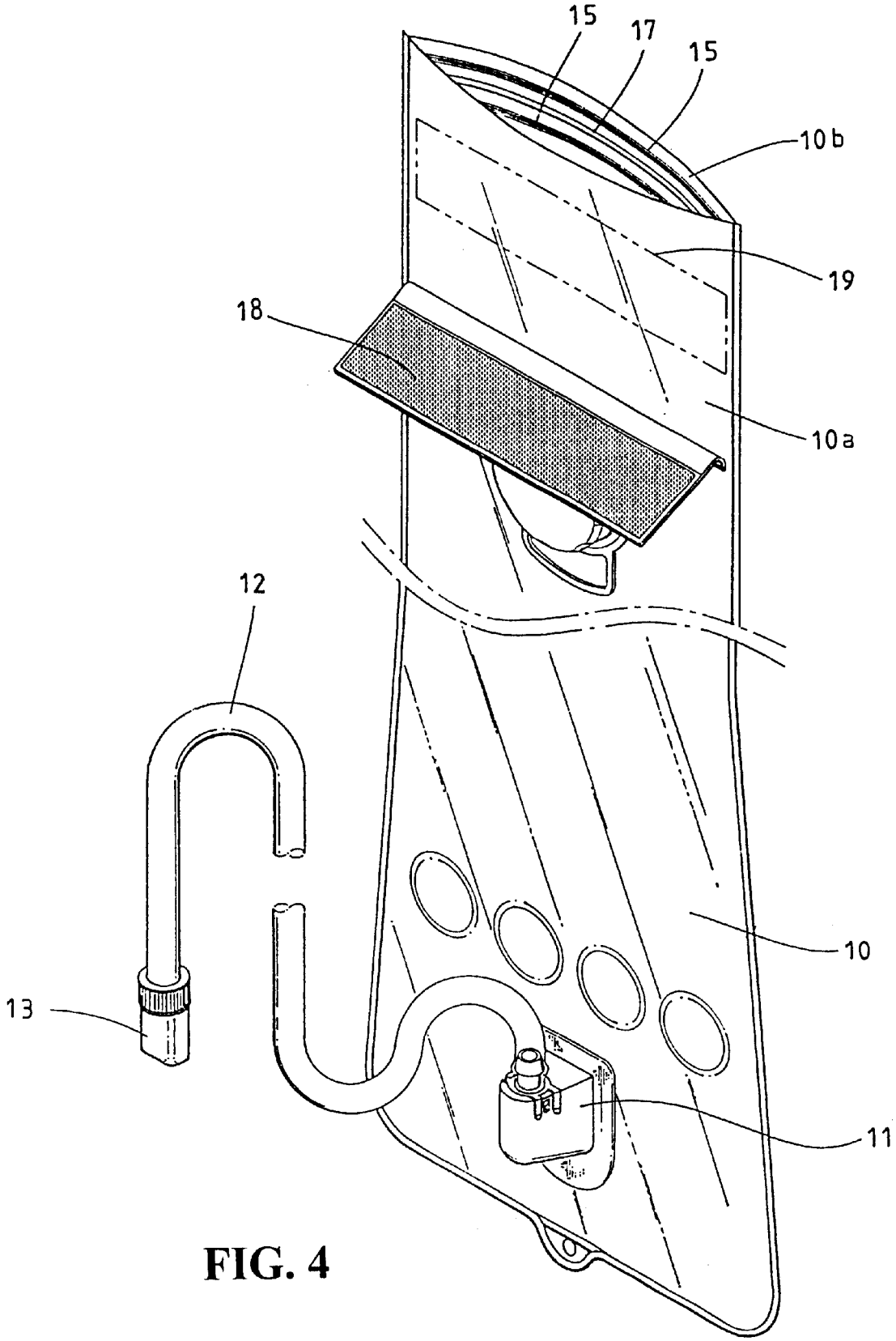
FIG. 4 illustrates the mouth of the water bag opened according to the present invention.

Referring to FIGS. 3 and 4 and FIG. 2 again, the bag body 10 has a top side terminating in a mouth 14 formed of two opposite bag body panels 10*a*; 10*b*. Two transverse locating ribs 16 are fixedly provided in the inner sidewall of one bag body panel 10*a* at different elevations. Two transverse locating grooves 15 are formed in the inner sidewall of the other bag body panel 10*b* at different elevations corresponding to the transverse locating ribs 16. Transverse damping ribs 17 are respectively provided in the inner sidewalls of the bag body panels 10*a*; 10*b* between the transverse locating ribs 16 and the transverse locating grooves 15. The transverse damping ribs 17 have a smoothly arched peak. A strip of hook material 18 is transversely stitched to the outer sidewall of one bag body panel 10*a*. A strip of loop material 19 is transversely stitched to the outer sidewall of the other bag body panel 10*b* and adapted for receiving the strip of hook material 18.

Figure 5:
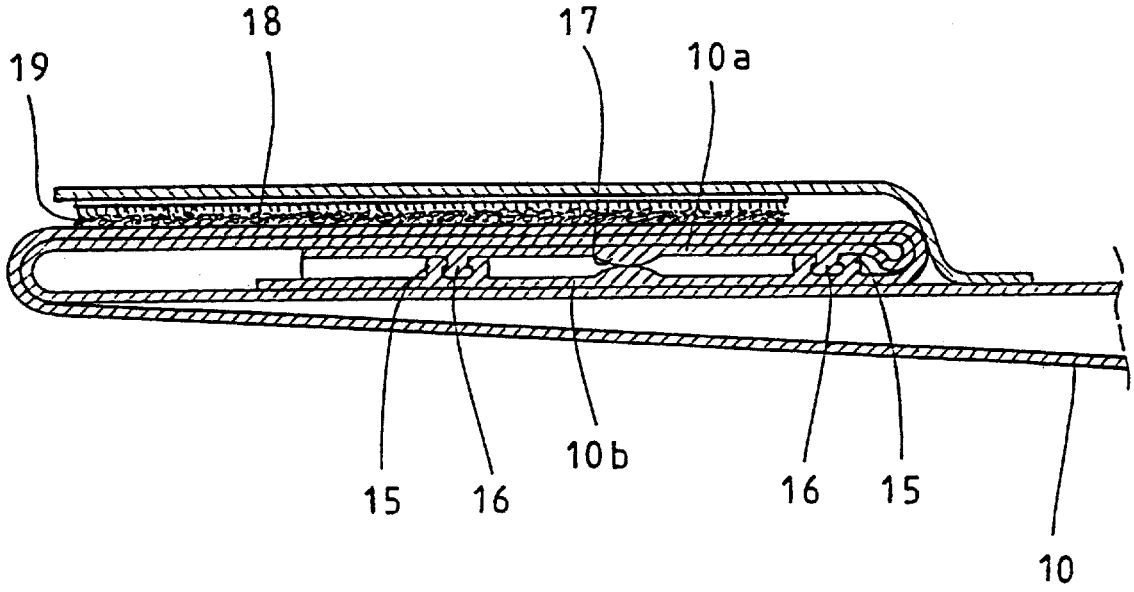
FIG. 5 is a sectional view in an enlarged scale of a part of the present invention.

Referring to FIG. 5 and FIGS. from 2 through 4 again, when closing the mouth, squeeze the bag body panels 10*a*; 10*b* against each other with the hands to force the transverse locating grooves 15 into engagement with the transverse locating ribs 16 and to close the mouth 14, and then roll up the closed mouth 14 for enabling the strip of hook material 18 to be fastened to the strip of loop material 19 to positively secure the mouth 14 in the closed rolled up status. When unfasten the strip of hook material 18 and the strip of loop material 19, the user can easily open the mouth 14 and then clean the inside of the bag body 10 conveniently thoroughly.

While only one embodiment of the present invention has been shown and described, it will be understood that various modifications and changes could be made thereunto without departing from the spirit and scope of the invention disclosed.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A water bag comprising a collapsible waterproof bag body adapted for holding water, and a water outlet tube extended from one end of said bag body and closed with a suction valve, wherein said bag body comprises a mouth in one end thereof remote from said water outlet tube and formed of a first bag body panel and a second bag body panel, said mouth comprising a plurality of locating ribs transversely formed in an inner sidewall of said first bag body panel at different elevations, a plurality of locating groves transversely formed in an inner sidewall of said second bag body panel and adapted for receiving said locating ribs to close said mouth, a plurality of damping ribs respectively transversely formed in said bag body panels between said transverse locating ribs and said transverse locating grooves, a strip of hook material provided at an outer sidewall of said first bag body panel, and a strip of loop material provided at an outer sidewall of said second bag body panel and adapted for fastening said strip of hook material to hold said mouth in a closed rolled up status.

2. The water bag as claimed in claim 1, wherein said damping strips each have a smoothly arched peak.

* * * * *